US006440651B1

(12) United States Patent
Buongiorne et al.

(10) Patent No.: US 6,440,651 B1
(45) **Date of Patent: *Aug. 27, 2002**

(54) CONCENTRATED PHOTOGRAPHIC FIXER ADDITIVE AND FIXING COMPOSITIONS AND METHOD OF PHOTOGRAPHIC PROCESSING

(75) Inventors: Jean M. Buongiorne, Brockport; Mary E. Craver, Rochester; Ramanuj Goswami, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/680,385

(22) Filed: Oct. 5, 2000

(51) Int. Cl.[7] ..... G03C 7/42
(52) U.S. Cl. ..... 430/398; 430/400
(58) Field of Search ..... 430/398, 400

(56) References Cited

U.S. PATENT DOCUMENTS

| | | | | |
|---|---|---|---|---|
| 4,232,112 A | | 11/1980 | Kuse | 430/393 |
| 4,587,195 A | | 5/1986 | Ishikawa et al. | 430/139 |
| 4,895,786 A | | 1/1990 | Kurematsu et al. | 430/139 |
| 5,043,253 A | | 8/1991 | Ishikawa | 430/393 |
| 5,147,765 A | | 9/1992 | Goto et al. | 430/376 |
| 5,221,597 A | | 6/1993 | Fujita et al. | 430/393 |
| 5,272,044 A | | 12/1993 | Nishigaki et al. | 430/393 |
| 5,955,248 A | | 9/1999 | Craver et al. | 430/458 |
| 6,013,425 A | | 1/2000 | Craver et al. | 430/455 |
| 6,153,365 A | * | 11/2000 | Goswami et al. | 430/455 |

FOREIGN PATENT DOCUMENTS

| | | |
|---|---|---|
| EP | 0 565 023 A1 | 10/1993 |
| JP | 10 104809 | 4/1998 |
| WO | WO 97/10887 | 3/1997 |

OTHER PUBLICATIONS

JP Abstract 10104809.
JP Abstract 1062642.
JP Abstract 1158443.
JP Abstract 58–222156.
DE Abstract 2203302.
*Research Disclosure*, Item 37336, May 1995.
*Research Disclosure*, Item 20733, Jul. 1981.

* cited by examiner

*Primary Examiner*—Hoa Van Le
(74) *Attorney, Agent, or Firm*—J. Lanny Tucker

(57) ABSTRACT

Concentrated aqueous photographic fixing compositions include a photographic fixing agent and a compound represented by Structure I

I wherein R is carboxy or sulfo, m is an integer of from 0 to 7 and n is an integer of from 2 to 5. This compound is provided in a concentrated aqueous fixer additive composition. These compositions can be used to provide images in color photographic materials, and particularly in color reversal films, with reduced residual sensitizing dye stain.

5 Claims, No Drawings

CONCENTRATED PHOTOGRAPHIC FIXER ADDITIVE AND FIXING COMPOSITIONS AND METHOD OF PHOTOGRAPHIC PROCESSING

FIELD OF THE INVENTION

This invention relates to novel concentrated photographic fixer additive and concentrated photographic fixing compositions. It also relates to methods of using these concentrated compositions in photoprocessing. Thus, this invention relates to the photographic industry and to photochemical processing in particular.

BACKGROUND OF THE INVENTION

The conventional image-forming process of silver halide photography includes imagewise exposure of a photographic silver halide recording material to actinic radiation (such as actinic light), and the eventual manifestation of a useable image by wet photochemical processing of that exposed material. A fundamental step of photochemical processing is the treatment of the material with one or more developing agents to reduce silver halide to silver metal. With black-and-white photographic materials, the metallic silver usually comprises the image. With color photographic materials, the useful image consists of one or more images in organic dyes produced from an oxidized developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved with an oxidizing agent, commonly known as a bleaching agent.

Fixing is typically carried out using a fixing composition that includes one or more fixing agents such as thiosulfate salts. Both ammonium and sodium thiosulfate salts are known. Fixing solutions containing ammonium ions are preferred for providing more rapid fixing, but they present environmental concerns. Thus, fixing solutions containing sodium ions, while slower, are also advantageous.

Color photographic silver halide materials often contain various sensitizing dyes that extend the inherent photosensitivity of the photosensitive silver halide emulsions to electromagnetic radiation. One important class of such sensitizing dyes are carbocyanine sensitizing dyes that are commonly included in silver halide emulsion layers in photographic silver halide films, for example in color reversal photographic silver halide films (films normally used to provide positive color images).

Many photographic silver halide elements contain residual sensitizing dyes after photoprocessing. In some cases, the level of retained sensitizing dyes is inconsequential and thus, unobservable. In other instances, however, the high level of retained sensitizing dye results in undesirably high dye stain (or unwanted color) in the elements.

A number of solutions have been proposed for this problem, including the inclusion of water-soluble stilbene optical brighteners in the color developer solution [as described for example, in *Research Disclosure*, 20733, page 268, July, 1981 and U.S. Pat. No. 4,587,195 (Ishikawa et al)], the bleach-fixing solution [as described for example, in JP 1-062642 (published Mar. 9, 1989), JP 1-158443 (published Jun. 21, 1989), and U.S. Pat. No. 5,043,253 (Ishikawa)], or the stabilizing solution used at the end of the photoprocessing [as described for example in U.S. Pat. No. 4,895,786 (Kurematsu et al)].

Concentrated and working strength fixing compositions that solve the residual dye stain problem are described in U.S. Pat. No. 6,013,425 (Craver et al). These compositions contain certain triazinylstilbene compounds as stain reducing agents. While they are quite effective in this regard, keeping them in solution may require the presence of one or more water-soluble stabilizing compounds such as glycols.

The problems with residual sensitizing dyes have also been satisfactorily addressed by incorporating certain stain reducing agents into one or more working strength photographic processing compositions. These compounds are described in copending and commonly assigned U.S. Ser. No. 09/464,551 filed Dec. 16, 1999 by Goswami et al now U.S. Pat. No. 6,153,365, and U.S. Ser. No. 09/464,961 filed Dec. 16, 1999 by Goswami et al now U.S. Pat. No. 6,153,364, as colorless or slightly yellow compounds having an extended planar $\pi$ system that is devoid of a diarninostilbene fragment or fused triazole nuclei. While these compounds can be incorporated into various photoprocessing compositions, it is preferred to include them in concentrated photographic fixing compositions.

However, when we attempted to incorporate some of these stain reducing agents into concentrated solutions such as concentrated fixing solutions, we found that some of them did not pass our rigorous solubility tests. For example, many of them showed unacceptable solubility even when organic solvents were added, insolubility in solution at low temperature for lengthy times, or insolubility in concentrated fixing composition.

There remains a need in the photographic industry for a way to decrease the dye stains resulting from retained sensitizing dye during photoprocessing using concentrated processing compositions that meet all manufacturing, customer use, and storage stability requirements.

SUMMARY OF THE INVENTION

The problems with known photographic compositions and photoprocessing methods are overcome with the use of the present invention.

In one embodiment, the present invention provides a concentrated aqueous fixer additive composition consisting essentially of:

a) at least 0.01 mol/l of a compound having the structure I

I

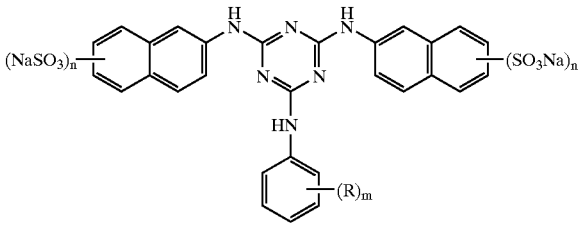

wherein R is carboxy or sulfo, m is an integer of from 0 to 5 and n is an integer of from 2 to 7, and b) water.

This concentrated fixer additive composition can be used to advantage to prepare the concentrated aqueous fixing composition of this invention, which composition has a pH of 8 or less and consists essentially of:

a) at least 2 mol/l of a photographic fixing agent, b) at least 0.0001 mol/l of a compound represented by Structure I noted above, and c) water.

Once the concentrated aqueous fixing composition is prepared, it can be used to prepare an aqueous working strength fixer or replenisher. Thus, this invention further provides a method of making an aqueous working strength fixing composition comprising the steps of:

A) preparing the concentrated aqueous photographic fixing composition noted above by mixing the concentrated fixer additive composition described above with the photographic fixing agent, and B) diluting the resulting concentrated aqueous photographic fixing composition from about 2 to about 15 times.

This invention further provides a method for providing a color image comprising:

A) bleaching an imagewise exposed and color developed color photographic silver halide element, and B) prior to or after step A, fixing the photographic element with an aqueous working strength photographic fixing composition prepared from the concentrated fixing composition described above.

Step B of this method can also be carried out by diluting, at least 2 times, the concentrated aqueous photographic fixing composition described above.

The advantages of this invention are several. The concentrated fixer additive composition can be manufactured, provided and stored for considerable time without precipitation of the stain reducing agent, thereby reducing the costs associated with volume and storage. The fixer additive composition volume can be small enough so as not to significantly dilute the concentrate to which it is added. Because there is no need for solvents other than water, there is no additional environmental burden. The resulting working strength fixing composition is also highly stable, and can be used to advantage to reduce stain from retained sensitizing dyes in processing photographic silver halide elements.

Only the specific stain reducing agents represented by Structure I provide the desired stability in the concentrated compositions of this invention. Thus, the compounds of Structure I meet the following minimal stability standards:

a) they are soluble at 33 g in 500 ml of water, b) they have low temperature solubility that is determined by placing 100 ml aqueous samples of the compounds in closed containers and holding them individually it at 0° F. (−18° C.), 20° F. (−7° C.), 30° F. (−1 C.), 40° F. (4° C.), 50° F. (10° C.) and 70° F. (21° C.) for 14 days and then observing the samples 24 hours later for signs of precipitation or other observable changes (for example color, presence of haze, or phase separation), and c) they cause no precipitation at 33 g in a 18.9 liter volume of commercially available KODAK Fixer and Replenisher Process E-6 AR at room temperature for at least 3 days (preferably at least 10 days).

Working strength fixing compositions can be prepared in several ways using the present invention. The concentrated fixer additive composition can be added directly to a working strength composition containing a suitable fixing agent, or mixed with the appropriate fixing agents in appropriate amounts to form the concentrated aqueous fixing composition. This composition can then be diluted in an appropriate manner and used for photoprocessing.

DETAILED DESCRIPTION OF THE INVENTION

The concentrated and working strength photographic fixing compositions described herein perform only one photoprocessing function, fixing. They do not perform a bleaching function, so the compositions are not bleach-fixing compositions. The language "consisting essentially of" is intended to indicate that no photographic bleaching agents (such as iron chelates, peroxides or persulfates) are intentionally added to the fixing composition of this invention. Any small amounts of bleaching agents may be present merely because of carryover from previous photoprocessing baths.

The language "consisting essentially of" is also meant to exclude significant amounts of organic solvents such as solubilizing solvents in the fixing concentrates or fixer additive compositions of this invention. Such solvents may be present in small amounts that have no meaningful effect.

As used herein unless otherwise indicated, the term "fixing compositions" refers to both the concentrated and working strength fixing compositions.

Useful fixing agents for photographic fixing compositions are well known. Examples of photographic fixing agents include, but not limited to, thiosulfates (for example sodium thiosulfate, potassium thiosulfate and ammonium thiosulfate), thiocyanates (for example sodium thiocyanate, potassium thiocyanate and ammonium thiocyanate), thioethers (such as ethylenebisthioglycolic acid and 3,6-dithia-1,8-octanediol), imides and thiourea. Thiosulfates and thiocyanates are preferred, and thiosulfates are more preferred. Ammonium thiosulfate is most preferred.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al).

A critical component of the concentrated fixer additive and photographic fixing compositions of this invention is a spectral sensitizing dye stain reducing agent that is a 2,6-dinaphthylaminotriazine compound as represented by Structure I (or mixture thereof). These compounds have at least four sulfonate solubilizing groups attached to the naphthyl rings and specific substituents attached to the triazine ring.

The compounds useful in this invention can be represented by Structure I:

I

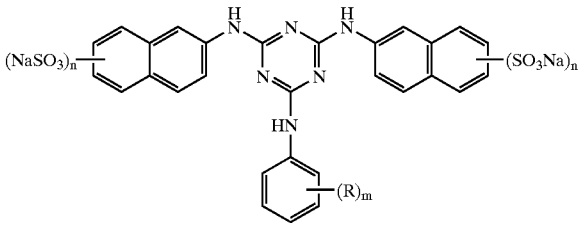

wherein R is carboxy (or salt thereof) or sulfo (or salt thereof), m is an integer of from 0 to 5, and n is an integer of from 2 to 7. Preferably, R is carboxy, m is an integer of 1 to 2, and n is 2.

Representative compounds within Structure I are the following Compounds I-1 to I-7:

I-1

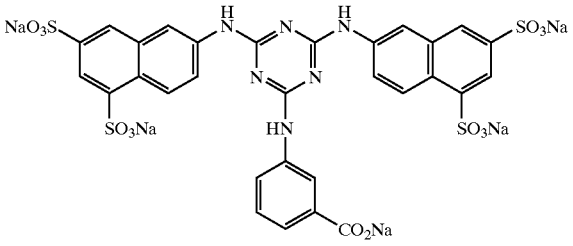

I-2

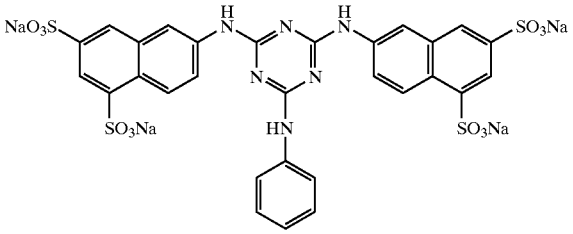

I-3

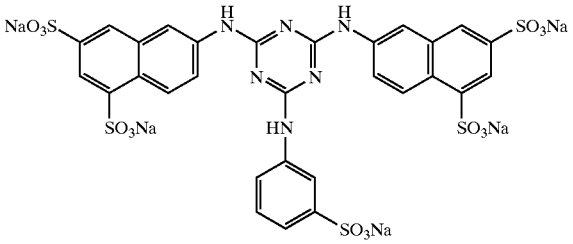

I-4

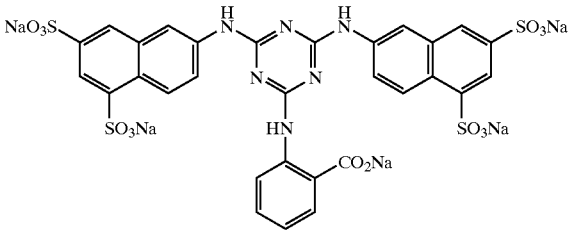

I-5

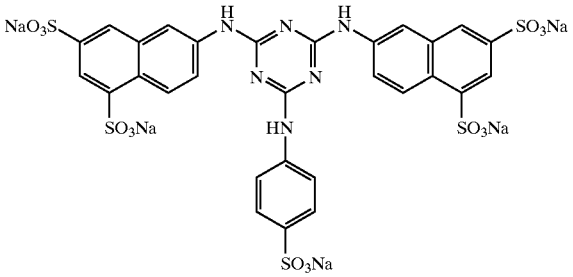

I-6

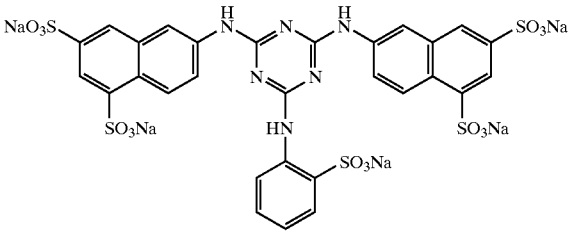

-continued

I-7

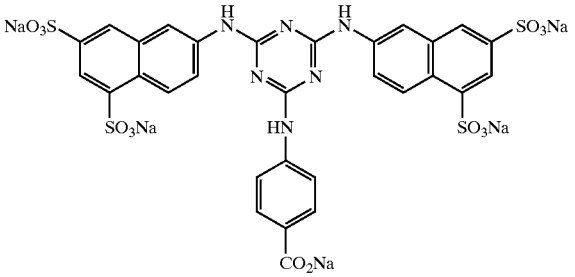

Single compounds or mixtures thereof can also been used in the practice of this invention. Compound I-1 (or an alkali metal salt thereof) noted above is most preferred.

These 2,6-dinaphthylaminotriazine compounds can be prepared using the methods described for example in WO 97/10887. A representative synthesis of preferred Compound I-1 is provided below.

The concentrated fixer additive compositions of this invention have only two essential components: one or more compounds of Structure I and water. However, optional and nonessential components may be present if desired. Such components include buffers, sequestering agents, preservatives (such as sulfites), and other addenda that would be readily apparent to one skilled in the art.

While the concentrated fixing compositions of this invention have only three essential components: one or more fixing agents, one or more compounds of Structure I, and water, they can also include one or more of various nonessential addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art. The amounts useful in the concentrate compositions would be readily apparent from the teaching included herein.

The desired pH of the fixing compositions of this invention is 8 or less, and can be achieved and maintained using any useful combination of acids and bases, as well as various buffers. The pH of the concentrated fixing composition can vary from that of the working strength fixing composition.

Other details of fixing compositions not explicitly described herein are considered well known in the art, and are described for example, in *Research Disclosure* publication 38957 (noted below), and publications noted therein in paragraph XX(B), incorporated herein by reference.

The following TABLE I shows the general and preferred pH and amounts of essential components of the concentrated additive composition and the fixing compositions of this invention. The preferred ranges are listed in parentheses ( ), and all of the ranges are considered to be approximate or "about" in the upper and lower end points. During fixing, the actual concentrations can vary depending upon extracted chemicals in the composition, fixer replenishment rates, water losses due to evaporation and carryover from the preceding processing bath and carryover to the next processing bath. The working strength fixing composition concentrations are based on a dilution rate of from about 2 to about 15 of the concentrated fixing composition.

TABLE I

| COMPONENT | CONCENTRATED FIXER ADDITIVE COMPOSITION | CONCENTRATED FIXING COMPOSITION | WORKING STRENGTH FIXING COMPOSITION |
|---|---|---|---|
| Fixing agent | None | 2–6 mol/l (3–5 mol/l) | 0.1–2 mol/l (0.2–1 mol/l) |
| 2,6-dinaphthyl-aminotriazine | 0.01–0.5 mol/l (0.05–0.3 mol/l) | 0.0001–0.015 mol/l (0.0002–0.01 mol/l) | 0.00005–0.001 mol/l (0.0001–0.000mol/l) |
| pH | Not relevant | 4.5–8 (5.5–7.5) | 4.5–8 (5.5–7.5) |

During fixing, the fixing composition in the processor may accumulate dissolved silver halide, and other substances that are extracted from the processed photographic element. Such materials, and particularly silver halide, can be removed using known means, such as ion exchange, electroysis, electrodialysis and precipitation.

Fixing can be carried out using a single working strength fixing composition bath (single stage), or multistage methods. Agitation or recirculation can also be used if desired. Fixing can also be carried out using any known method for contacting a fixing composition and the photographic element. Such methods include, but not limited to, immersing the photographic element in the working strength fixing composition, laminating a cover sheet containing the fixing composition to the photographic element, and applying the fixing composition by high velocity jet or spraying.

Since the fixing step is a separate step in an overall image-forming method, any processing sequence can be used for processing either black-and-white or color photographic elements. Representative processing sequences are described for example in *Research Disclosure* publication 308119, December 1989, publication 17643, December 1978, and publication 38957, September 1996. *Research Disclosure* is a publication of Kenneth Mason Publications Ltd., Dudley House, 12 North Street, Emsworth, Hampshire PO10 7DQ England. For example, in processing black-and-white photographic elements, fixing is usually preceded by a developing step, and may be followed with one or more washing or stabilizing steps.

Preferably, the compositions of the present invention are used to process color photographic elements, including but not limited to, color negative photographic films, color reversal photographic films, and color photographic papers. The general sequence of steps and conditions (times and temperatures) for processing are well known as Process C-41 and Process ECN-2 for color negative films, Process E-6 and Process K-14 for color reversal films, and Process RA-4 for color papers. The processing solutions used for the various processing steps in such processing sequences are also well known (except for the fixing steps carried out in this invention).

More preferably, the compositions are used to provide positive color images in color reversal photographic films. The typical sequence of steps includes first development (black-and-white development), reversal processing step, color developing, bleaching, fixing, and stabilizing. There may be various washing steps between other steps, as well as a pre-bleach step or conditioning step before bleaching. Alternatively, stabilizing can occur between color developing and bleaching. Many details of such processes are provided in U.S. Pat. No. 5,552,264 (Cullinan et al), incorporated herein by reference. Other details are provided in *Research Disclosure*, publication 38957 (noted above), and references noted therein.

Color reversal films are comprised of a support having thereon a plurality of photosensitive silver halide emulsion layers that can contain any conventional silver halide (or mixture thereof). Such films generally have silver halide emulsions having at least 1 mol % iodide based on total silver.

Useful supports are well known and include polyester films, polycarbonate films and cellulose acetate films. The silver halide layers include conventional binder materials, and other conventional addenda. Some specific commercially available color reversal photographic films that can be processed using this invention include EKTACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (3M Corporation).

The first developing step is usually carried out using a conventional black-and-white developing solution that can contain black-and-white developing agents, auxiliary co-developing agents, preservatives, antifoggants, antisludging agents, buffers and other conventional addenda.

Color developing is generally carried out using one or more conventional color developing agents, such as primary amino color developing agents. The color developing solution can also include various other conventional addenda including preservatives (including hydroxylamine and its derivatives), fluorescent dyes, sulfites, sequestering agents, corrosion inhibitors and buffers.

Bleaching is generally carried out using one or more bleaching agents that convert metallic silver to silver ions. Binary and ternary ferric complexes of aminopolycarboxylic acids are common bleaching agents, as well as persulfates and peroxides. Other components of the bleaching solution include buffers, halides and sequestering agents.

A photographic stabilizing step can be carried out using any dye stabilizing solution known in the art. Alternatively, a final rinsing step can be used.

For the fixing step of the method of this invention, the concentrated fixing composition of this invention can be diluted up 15 times, and preferably from 2 to 15 times (more preferably from 5 to 12 times), to provide a working strength or fixing replenishing composition. Dilution can be carried out during or prior to its use in the image formation process. In addition, the concentrated fixing composition can be added to the fixing solution bath, or to the fixer replenisher.

Fixing is generally carried out for conventional times and under conventional conditions. In addition, the fixing compositions of this invention can be used in what would be considered "rapid" processing wherein the fixing step is carried out for as few as 10 seconds.

Processing can be carried out using any suitable processing equipment, including deep tank processors, and "low volume thin tank" processes including rack and tank and automatic tray designs, as described for example in U.S. Pat. No. 5,436,118 (Carli et al), and publications noted therein. Rotary tube processors can also be used for processing color reversal films.

The concentrated fixing composition of this invention is prepared by mixing the fixing agent and other fixing composition components (in appropriate amounts) with the concentrated additive composition of this invention. Alternatively, the Structure I compound can be added directly to the concentrated fixing composition.

The working strength composition can be prepared either by diluting the concentrated fixing composition appropriately with water and/or buffers, or by adding the concentrated fixing composition directly to the fixing bath or fixer replenisher.

The following synthetic procedure and examples are provided to illustrate the invention, and not to be limiting in any fashion.

Preparation of Compound I-1

Cyanuric chloride (133.0 g, 0.72 mole) was dissolved in 3 liters of acetone in a 12-liter flask equipped with a mechanical stirrer. Crushed ice (3 kg) was added to it. To this cold mixture was added all at once, while stirring, a solution containing 6-amino-1,3-naphthalenedisulfonic acid disodium salt (605 g, 88% purity, 1.53 mole) in 1800 ml water and 1200 g of ice. An aqueous solution (200 ml) of sodium hydroxide (57.6 g, 1.44 mole) was added portion-wise with stirring to the resulting mixture, as the reaction pH became acidic. The first 100 ml portion was added over 15 minutes while the reaction temperature was still less than 0° C. This reaction mixture was then heated gradually by using a steam bath. The remaining 100 ml were added gradually over the next 1.25 hours while the reaction temperature was raised to 60° C. The reaction mixture was stirred at 60° C. for an additional 2 hours and was then cooled to room temperature.

The resulting reaction mixture was slowly poured into a solvent mixture containing 60 liters of acetone and 6 liters of methanol, while stirring. It was then allowed to settle overnight and 40 liters of solvent was removed by decanting. The resulting solid was collected on an 11.5 inch (29.2 cm) diameter funnel using a VWR #413 filter paper. The solid was then washed with acetone and P950 ligroin, and was air-dried on the funnel. The resulting solid clumps were crushed and the powder was dried in a vacuum oven overnight, giving rise to 560 g (yield: 96.5%) of the desired chloro intermediate.

Sodium bicarbonate (118 g, 1.4 mole) was added to 2.5 liters of water in a 5-liter flask. 3-Aminobenzoic acid (92 g, 0.67 mole) was added portion-wise to this solution while being heated to 85° C. The chloro intermediate prepared as described above (550 g, 0.68 mole) was added to this solution portion-wise over a period of 15 minutes. The resulting mixture was heated at 85–90° C. overnight. It was then allowed to cool to room temperature overnight. Small amounts of insoluble materials were filtered off using a glass-fiber filter paper. The filtrate was poured into 11 liters of acetone. It was stirred for 5 minutes and was allowed to settle. The clear acetone supernatant was decanted off. The resulting amber oil was added to a mixture of 25 liters of acetone and 2.5 liters of methanol, and was stirred for 10 minutes. The resulting solid was collected on an 11.5 inch (29.2 cm) diameter funnel using a VWR #413 filter paper. The resulting solid was first washed with a mixture containing 10:1 acetone:methanol (5 liters), then with acetone (5 liters), and finally with P950 ligroin (5 liters). The solid was then air-dried on the funnel. The solid clumps were crushed and the powder was dried in a vacuum oven at 50° C. for 2 days, giving rise to 547 g (yield: 87.8%) of the desired Compound I-1.

EXAMPLE 1

Preferred Concentrated Fixer Additive Composition

A preferred concentrated fixer additive composition of this invention was prepared by mixing Compound I-1 (0.28 mol/l) in water.

This concentrated additive composition was tested for stability using the following three tests that are more rigorous than the three minimal stability standards described above:

a) room temperature solubility of Compound I-1 (66 g) in 250 ml of water, b) low temperature solubility determined by placing 100 ml samples of the composition in a glass jar and holding them individually at 0° F. (−18° C.), 20° F. (−7° C.), 30° F. (−1° C.), 40° F. (4° C.), 50°F. (10° C.) and 70° F. (21° C.) for 14 days, and then observing any physical changes (such as precipitation) 24 hours thereafter, and c) solubility of Compound I-1 (66 g) in a 18.9 liter volume of commercially available KODAK Fixer and Replenisher Process E-6 AR at room temperature, and no observable precipitation, for at least 3 days.

Compound I-1 passed all three of these rigorous tests.

EXAMPLES 2–8

Additional Fixer Additive Compositions

Other concentrated additive compositions of this invention were prepared by adding Compounds I-1 (0.22 mol/l), I-2 (0.22 mol/l), I-3 (0.14 mol/l), I-4 (0.20 mol/l), I-5 (0.22 mol/l), I-6 (0.20 mol/l), or I-7 (0.22 mol/l) to water as described in Example 1. These compositions were subjected to three stability tests as described in Example 1, except that the amount of compound used in tests a) and c) was 47 g instead of 66 g. All of these compounds passed all three stability tests.

EXAMPLE 9

Concentrated Fixing Composition

A preferred concentrated fixing composition of this invention was prepared by mixing the concentrated fixer additive of Example 1 and other components to provide the following formulation:

| | |
|---|---|
| Ammonium thiosulfate fixing agent | 4.76 mol/l |
| Compound I-1 | 0.0037 mol/l |
| Sodium metabisulfite | 0.6 mol/l |
| Ethylenediaminetetraacetic acid | 0.02 mol/l |
| Sodium hydroxide | 0.25 mol/l |
| pH | 6.18 |

EXAMPLE 10

Working Strength Fixing Compositions

A working strength fixing composition was prepared by diluting the concentrated fixing composition of Example 9, ten times with water. The working strength fixing compositions were used both in processor fixing baths as well as fixing replenishers to process several commercially available color reversal photographic films in the following manner.

Samples of FUJICHROME Color Reversal Films, AGFACHROME Color Reversal Films and EKTACHROME Color Reversal Films were imagewise exposed and processed using the following processing sequence and noted conditions and processing compositions (all compositions are commercially available except for the fixing compositions):

| PROCESSING STEP | PROCESSING COMPOSITION | PROCESSING TIME | PROCESSING TEMPERATURE |
|---|---|---|---|
| First Development | KODAK First Developer, Process E-6 | 360 seconds | 38° C. |
| Washing | Water | 120 seconds | 38° C. |
| Reversal bath | KODAK Process E-6 AR Reversal Bath & Replenisher | 120 seconds | 38° C. |
| Color development | KODAK Color Developer, Process E-6 | 360 seconds | 38° C. |
| Conditioning or Prebleaching* | HUNT C6R Conditioner & Replenisher, or KODAK Prebleach Replenisher II, Process E-6, or KODAK Conditioner and Replenisher, Process E-6AR/MX-1600 | 120 seconds | 38° C. |
| Bleaching | KODAK Bleach, Process E-6 | 360 seconds | 38° C. |
| Fixing | Example 3 or 4 | 120 seconds, 240 seconds or 360 seconds | 38° C. |
| Washing | Water | 120 seconds | 38° C. |
| Stabilizing or Final rinsing* | HUNT C6R Stabilizer & Replenisher, Process E-6 or KODAK Final Rinse & Replenisher, Process E-6AR or KODAK Stabilizer and Replenisher, Process E-6AR/MX-1600 | 60 seconds | 38° C. |

*Some experiments were carried out using conditioning and stabilizing steps in the process, while other experiments were carried out using prebleaching and final rinsing steps in the process. The effects of the use of these different steps on the performance of the present invention were insignificant.

COMPARATIVE EXAMPLE 1

A concentrated fixer additive composition outside of this invention was prepared by mixing Compound I-8 shown below (0.075 mol/l) in water.

I-8

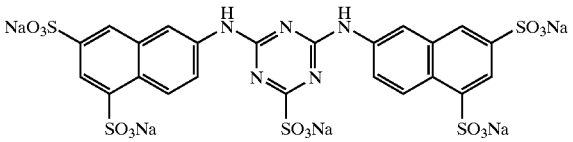

This Compound I-8 was tested for stability using the three minimal standard stability tests a), b) and c) described above in the Summary of the Invention. It did not pass test c).

The invention has been described in detail with particular reference to certain preferred embodiments thereof, but it will be understood that variations and modifications can be effected within the spirit and scope of the invention.

We claim:

1. A concentrated fixer additive composition consisting essentially of:

a) from about 0.01 to about 0.5 mol/l of a compound of having Structure I

I

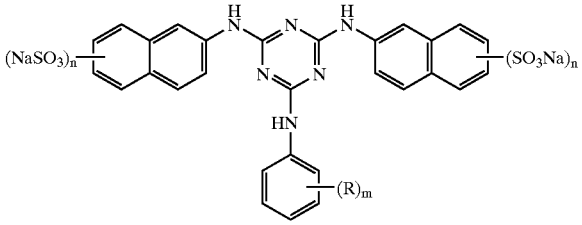

wherein R is carboxy or sulfo, m is an integer of from 0 to 5 and n is an integer of from 2to 7, and b) water.

2. The composition of claim 1 wherein said compound of Structure I is present in said composition in an amount of from about 0.05 to about 0.3 mol/l.

3. The composition of claim 1 wherein R is carboxy, m is 1 or 2, and n is 2.

4. The composition of claim 1 wherein said compound of Structure I is:

I-1

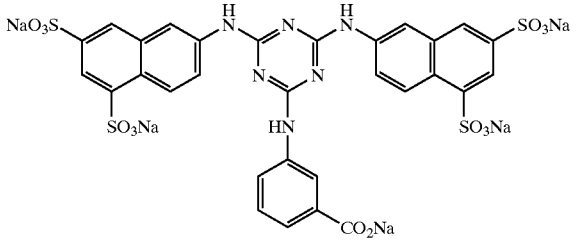

-continued
I-2
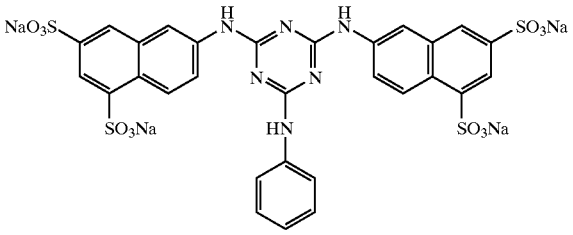
I-3
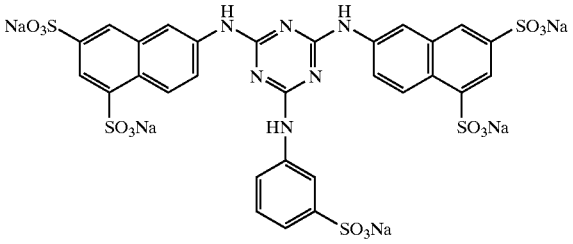
I-4
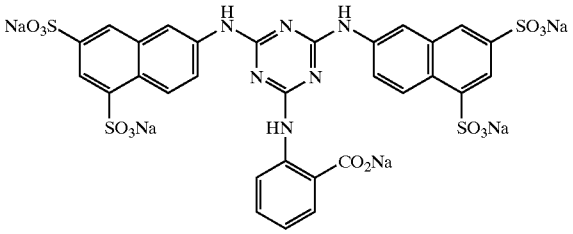
-continued
I-5
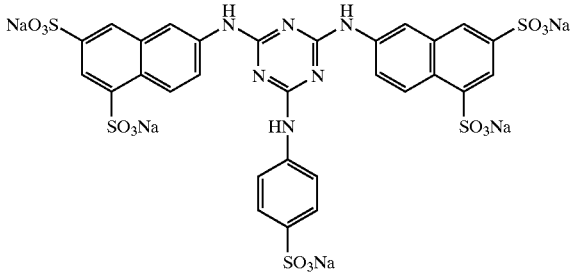
I-6
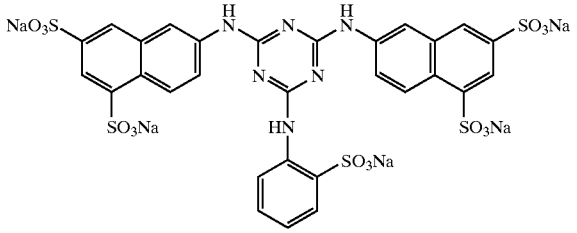
I-7
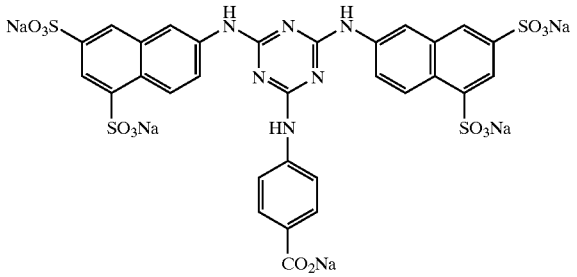
5. The composition of claim 1 wherein said compound of Structure I is Compound I-1.
* * * * *